United States Patent [19]

Deborde et al.

[11] Patent Number: 4,498,639

[45] Date of Patent: Feb. 12, 1985

[54] WEFT PREDELIVERY AND MEASURING DEVICE FOR A SHUTTLELESS LOOM

[75] Inventors: Albert H. Deborde; Pierre Rémond, both of Bourgoin Jailleu, France

[73] Assignee: Saurer-Diederichs Societe Anonyme, Bourgoin Jailleu, France

[21] Appl. No.: 419,468

[22] Filed: Sep. 17, 1982

[30] Foreign Application Priority Data

Oct. 13, 1981 [FR] France ..... 81 19628
Mar. 31, 1982 [FR] France ..... 82 05893

[51] Int. Cl.[3] ..... B65H 51/20

[52] U.S. Cl. ..... 242/47.01; 139/452; 242/47.12

[58] Field of Search ..... 242/47.01, 47.12, 47.13, 242/82, 83, 47; 139/452

[56] References Cited

U.S. PATENT DOCUMENTS 4,132,370 1/1979 Van Mullekom ..... 242/47.12
4,238,080 12/1980 Van Mullekom ..... 242/47.12

FOREIGN PATENT DOCUMENTS 123403 6/1967 Czechoslovakia ..... 242/47.12
0060234 9/1982 European Pat. Off. ..... 242/47.01

*Primary Examiner*—Stanley N. Gilreath
*Attorney, Agent, or Firm*—Karl F. Ross; Herbert Dubno

[57] ABSTRACT

A weft predelivery and measuring device for a shuttleless loom and particularly for such a loom with a lateral weft reserve and weft insertion by means of a pneumatic or hydraulic fluid has a tubular member integral with a rotary shaft through which an axial channel passes, facilitating the passage of the weft yarn into a tubular member for winding around a drum of adjustable peripheral dimensions. This drum is prevented from rotating by means of permanent magnets. In order to retain a predetermined number of turns of weft yarn around the drum and in order to release these turns periodically, a wheel is provided which on its periphery has equi-angularly spaced claws and which is supported by a spindle continuously rotatable by a worm and a worm gear driven from the rotary shaft.

7 Claims, 8 Drawing Figures

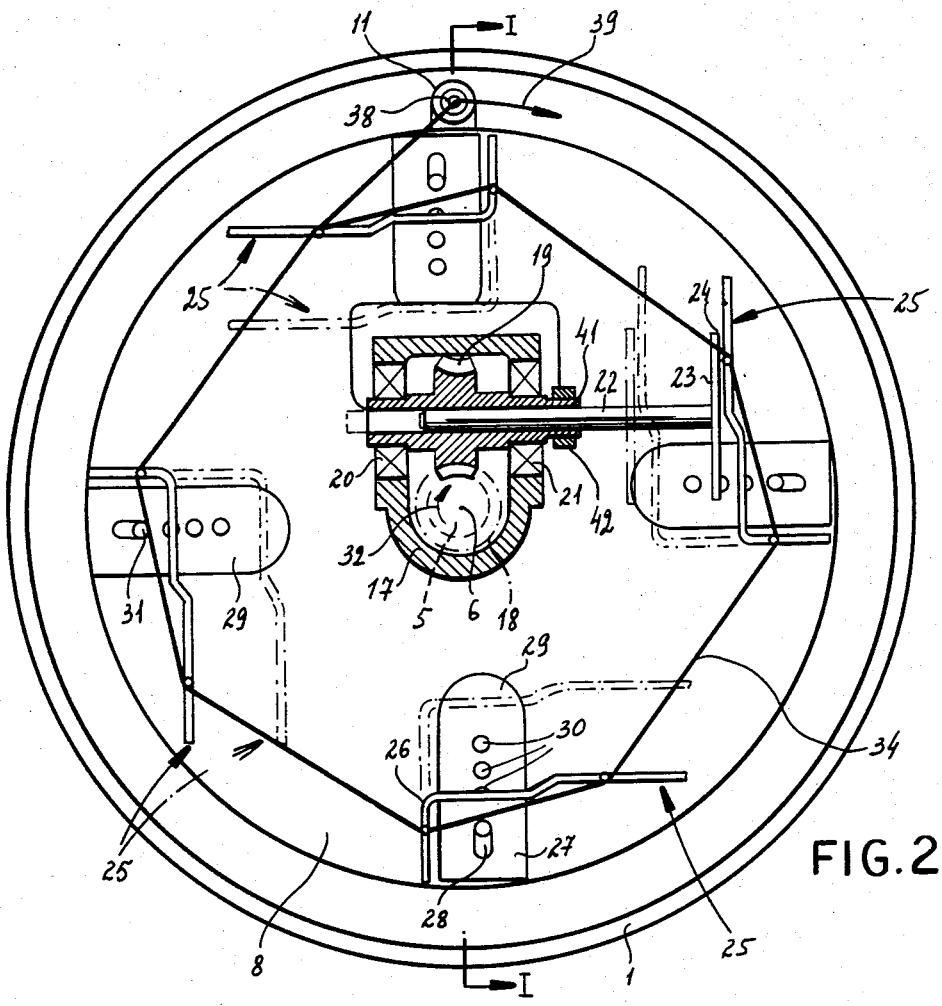
FIG. 2
FIG. 4
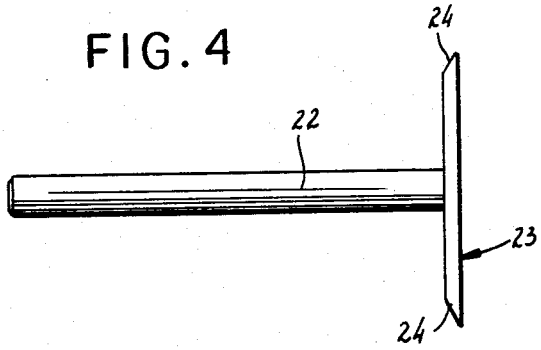
FIG. 3
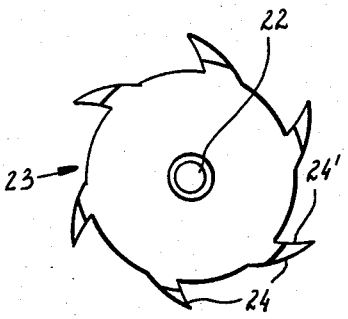

FIG. 6
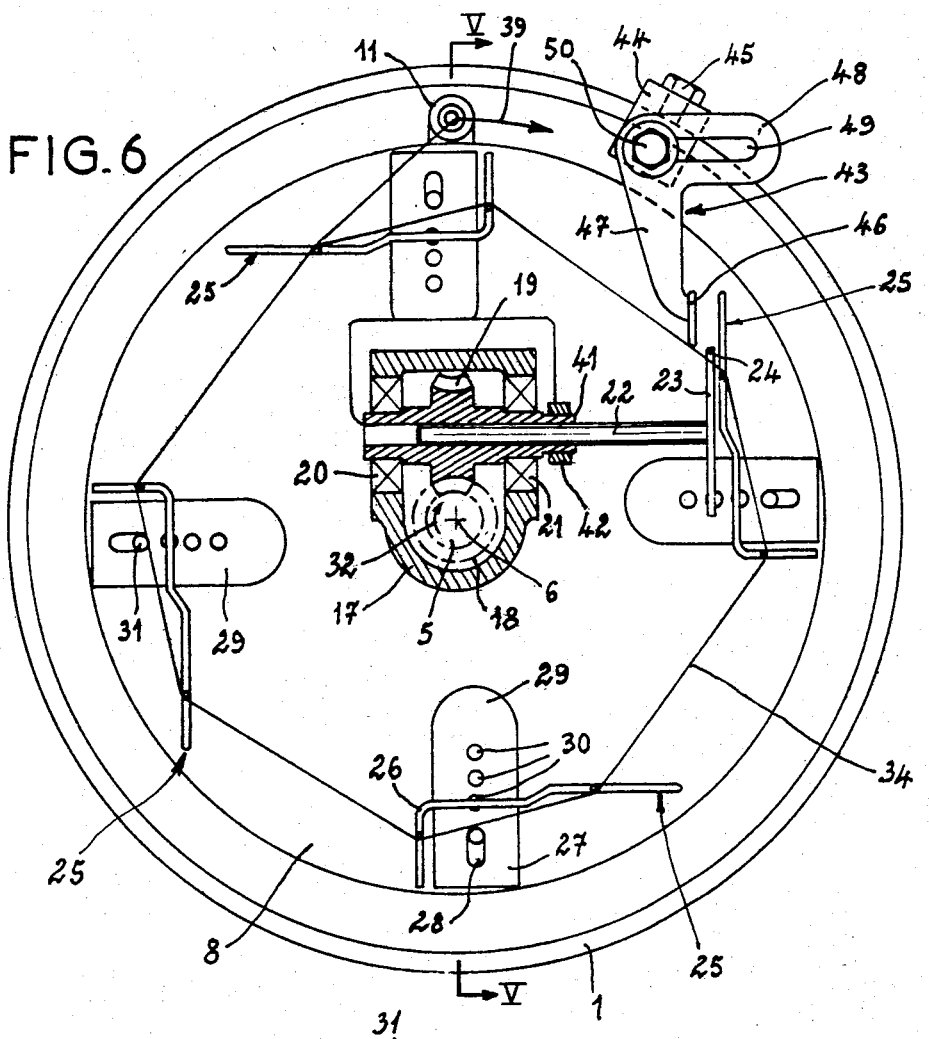
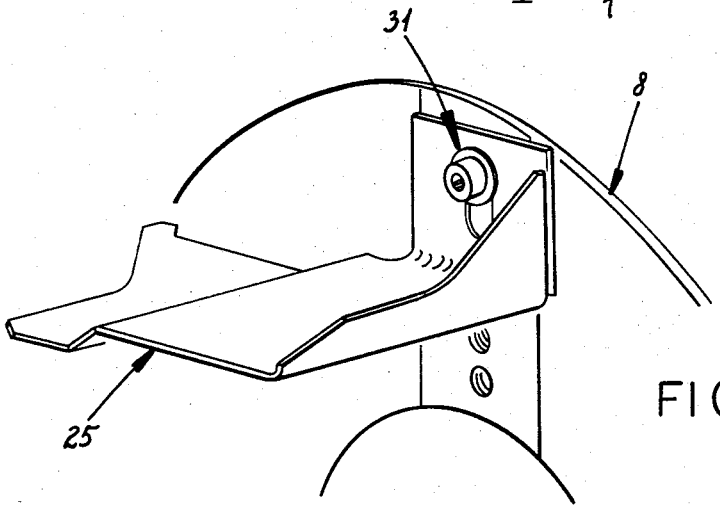
FIG. 2A

FIG.5
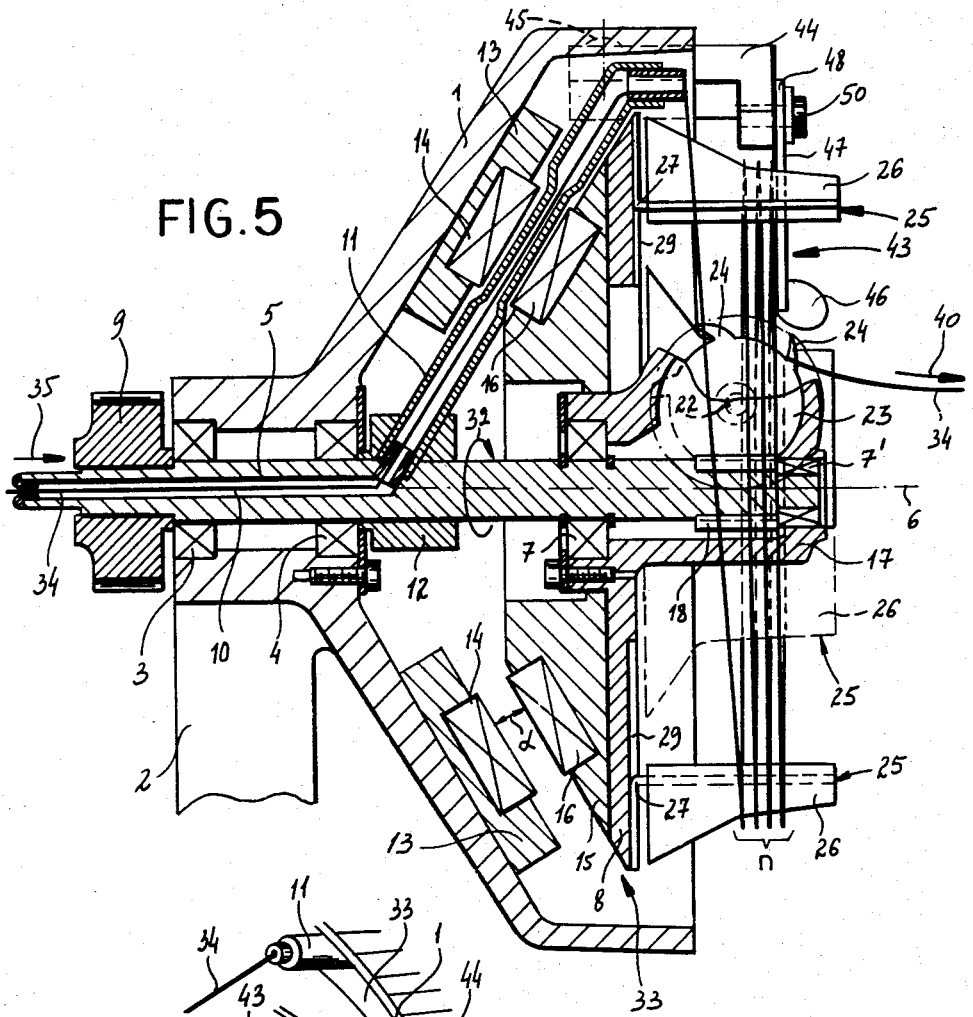
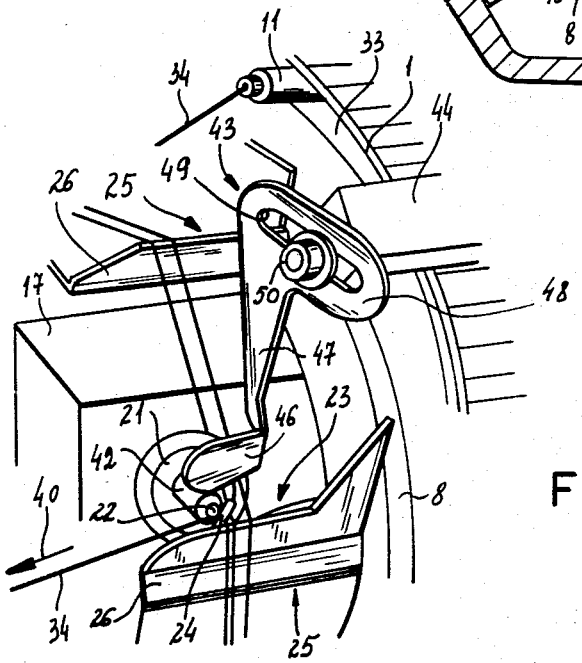
FIG.7

WEFT PREDELIVERY AND MEASURING DEVICE FOR A SHUTTLELESS LOOM

FIELD OF THE INVENTION

The present invention relates to a weft predelivery and measuring device for a shuttleless loom and, more particularly for a loom with a lateral weft reserve and insertion of this weft by drawing-off by means of a pneumatic or hydraulic fluid.

BACKGROUND OF THE INVENTION

In looms of this type, it is well known to provide in the path of the weft thread, between the bobbin located on one side of the machine and constituting the weft reserve, on the one hand, and the insertion nozzle, on the other hand, a predelivery and measuring device which stores cyclically a length of weft which is predetermined in accordance with the width of the fabric and which allows this length of weft stored provisionally to be drawn off at one go at the time of insertion.

More particularly, French Patent Publication No. 2,465,812 (French application 80-20,416) discloses a weft predelivery and measuring device in which a tubular member is connected to a rotary shaft passing through which is an axial channel facilitating the arrival of the weft and its passage into the said tubular member, for winding it around a drum of adjustable peripheral dimensions which is prevented from rotating, means being provided for retaining a predetermined number of turns of yarn wound around said drum and in order to release these turns periodically.

In this weft predelivery and measuring device, which uses the principle of winding on a fixed drum by means of a rotary member making it possible to deposit tangentially the desired number of turns, the length of these turns, and, therefore, the length of yarn stored before being drawn-off in order to effect the insertion of the weft, is made adjustable by providing that the winding drum comprises a radially fixed part, inside which are mounted the means for retaining and releasing the desired number of turns and a part constituted by radially adjustable members. The drum which results from this arrangement comprises, with respect to the axis of the device, a periphery which is more or less eccentric depending on the reduction in the width of the fabric with respect to the maximum width (warping). This eccentric arrangement causes a weft tension which varies according to a substantially sinusoidal law and creates a jerky movement at the time of pulling of the weft.

Moreover, in the above mentioned known device, the means for retaining and releasing the desired number of turns comprise an epicycloidal gear train, making it possible to drive spindles in a circular movement while keeping the spindles in a constant orientation, this epicycloidal train itself being driven by the rotary shaft supporting the radial tubular member through which the yarn passes. This drive includes a worm, a worm gear and an endless belt or chain passing over a driving pinion and over a receiving pinion. The arrangement constitutes a complex mechanism, comprising numerous pinions, shafts and bearings, the production and assembly of which are difficult in view of the small dimensions of the part inside which they are to be fitted. In addition, the design of this mechanism precludes any adjustment of the trajectory of the spindles for retaining turns and it is precisely for this reason that the drum is composed of a radially fixed part enclosing said mechanism and of a part constituted by radially adjustable members.

OBJECT OF THE INVENTION

The present invention intends to remedy these drawbacks by providing a weft predelivery and measuring device of the same type but which is greatly improved, to the effect that extremely simple means are provided for retaining and releasing a predetermined number of turns, these means being compatible with a drum structure allowing adjustments without any eccentricity of the periphery of this drum.

SUMMARY OF THE INVENTION

To this end, the means for retaining and releasing a predetermined number of turns are, in the weft predelivery and measuring device according to the invention, constituted by a wheel provided on its periphery with claws separated by constant angular intervals, this wheel comprising claws being supported by a spindle set in continuous rotation, by a worm and worm gear, from the rotary shaft supporting the radial tubular member through which the yarn passes and being located, relative to the periphery of the winding drum, so that each of its claws is able, in succession, to retain turns deposited around the drum then, by retracting subsequent to the rotation of the wheel, to release in one go all the turns deposited before that already retained by the following claw.

The desired result is thus obtained by a mechanism of extreme simplicity, comprising a worm, a worm gear and a wheel comprising claws, which is of the "ratchet wheel" type, the number of bearings necessary consequently being greatly reduced as will be easily understood.

Advantageously, in order to be able to adjust the length of yarn stored corresponding to a predetermined number of turns, the drum is constituted by a disc prevented from rotating and carrying a plurality of concentric weft supports, distributed at uniform angular intervals and which are all adjustable radially, the aforesaid wheel comprising claws being situated in the vicinity of one of these supports and having an adjustable position along its axis, in order to be able "to follow" the radial adjustment of the adjacent weft support.

Thus, the drum is no longer composed of a radially fixed part and of a part constituted by radially adjustable members, but has useful members which are all adjustable radially which can always be located approximately concentrically. However, a very slight deviation from the radial position of one of the members with respect to the others is not troublesome and thus it is possible to effect a fine adjustment on only one weft support after having positioned the other supports approximately.

In order to allow the wheel comprising claws to "follow" the adjustment of the adjacent weft support, the spindle of the said wheel comprising claws is advantageously mounted to slide inside the hub of the tangent wheel, the latter comprising means, such as a conical screwthread receiving a lock-nut, for its connection to the spindle of the wheel comprising claws in the desired position and an angular guide such as grooves or a flat portion in order to maintain the orientation of the claws.

The construction defined hitherto may possibly comprise the following drawback: at the time of insertion of the weft, the length of yarn wound on the supports of the drum and corresponding to the woven width is pulled-off and discharged abruptly and this is at the instant when the claw retaining the corresponding turns is retracted behind the adjacent weft support. When the weft is inserted and reaches the end of its travel, the last turn which has not become taut influences the first turn of the following storage operation, although this turn is in principle already retained by the new claw which has arrived to take the place of that which has disappeared.

At the instant when the turns are required, in order to prevent the first turn of the following store escaping from the claw before retaining it, the present invention proposes, as an additional feature, the addition to the weft predelivery and measuring device of a fixed retaining abutment, situated close to the periphery of the drum for winding the weft and located in the vicinity of the wheel comprising claws in order to keep the first weft turn already wound in position behind the following claw, when one claw is retracted in order to release the turns previously deposited on the drum. The retaining abutment, constituting an extremely simple additional accessory, combines its action with that of the wheel comprising claws in order to retain the new turn already deposited on the drum in a reliable manner, at the time of insertion of a previously stored length of weft and thus in order to guarantee the reliable and precise operation of the weft predelivery and measuring device. This retaining abutment is a static member, but its mounting may preferably be adjusted as regards position, in a plane at right angles to the axis of the drum, in order to be able to "follow" the adjustments of position of the weft supports of the drum as well as of the wheel comprising claws. According to a particular embodiment, the retaining abutment comprises an active part in the form of a rigid or flexible lug, connected to a base comprising a slideway for its adjustable mounting either directly on the stationary cover inside which the device is housed, or on a support in the form of an angle iron in turn fixed to the periphery of the said cover.

According to another feature of the invention, the disc which carries the aforesaid weft supports, as well as a casing enclosing the worm and the tangent wheel for setting the wheel comprising claws in rotation, is supported by the rotary shaft supporting the radial tubular member and this is through the intermediary of bearings, permanent magnets being carried on the one hand by this disc and on the other hand by a fixed cover in order to keep the disc in a virtually fixed angular position whilst providing a gap intended for the passage of the tubular member. The disc, thus the entire arrangement constituting the drum, is prevented from rotating by means which, without any mechanical complication, do not present an obstacle to the passage of the tubular member, the free end of which describes a circular trajectory along a slot of the same shape defined by the periphery of the disc and by that of the cover. Naturally, the magnets of the disc and of the cover must have corresponding arrangements and must be held by supports of non-magnetic material, if the disc and the cover are made from magnetic material.

BRIEF DESCRIPTION OF THE DRAWING

The accompanying diagrammatic drawing illustrates two embodiments of this weft predelivery and measuring device for a shuttleless loom. In the drawing

FIG. 2 is a sectional view on line 2—2 of FIG. 1;

FIG. 2*a* is a detail perspective view of the weft yarn support of the device;

FIGS. 3 and 4 are respectively front and side views to an enlarged scale, of the wheel comprising claws with its spindle;

FIG. 5 is an axial sectional view through a second embodiment of a weft predelivery and measuring device according to the invention, on line 5—5 of FIG. 6;

FIG. 6 is a front view, with partial section, of the weft predelivery and measuring device of FIG. 5; and FIG. 7 is a partial perspective view of the weft predelivery and measuring device of FIGS. 5 and 6, showing more particularly the arrangement of the retaining abutment.

SPECIFIC DESCRIPTION

Figure 1:
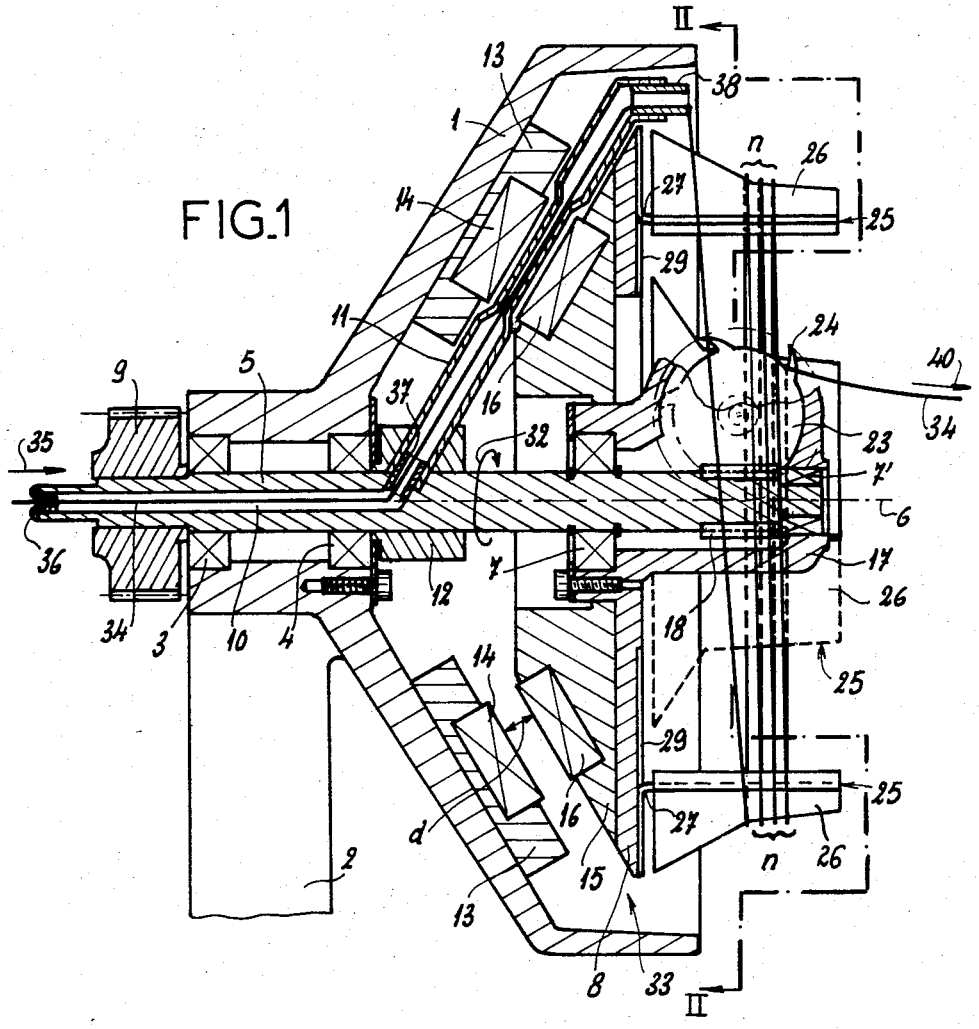
FIG. 1 is a sectional view taken along the axis of a first embodiment of a weft predelivery and measuring device according to the invention on line 1—1 of FIG. 2.

The device, shown in its entirety in FIG. 1, comprises a cover 1 mounted on the frame of the loom by means of a support 2. The hub of the cover 1 serves as a housing for bearings 3 and 4 in which a rotary shaft 5 is mounted, the latter rotating about the general axis 6 of the device. By means of two other bearings 7 and 7', the shaft 5 in turn supports a disc 8 which is located inside the cover 1.

Keyed on the rotary shaft 5 is a pinion 9 facilitating the rotary drive of this shaft from the driving source of the loom and in synchronism with the operation of the latter. Passing through the shaft 5 along its axis 6 and over part of its total length is a channel 10 which opens out at the rear end of the shaft 5 and which is extended substantially in the radial direction by a tube 11 connected to the shaft 5 by means of a securing block 12.

Fixed to the frustoconical inner face of the cover 1 are support blocks 13 of non-magnetic material, in which permanent magnets 14 are inserted. The disc 8, immobilized axially on the shaft 5, supports on its rear face a ring 15 of non-magnetic material, in which other permanent magnets 16 are inserted, the arrangement of which corresponds to that of the first magnets 14. The disc 8 is thus kept in a virtually fixed angular position, despite the rotary movement of the shaft 5 which supports it. The gap d which exists between the magnets 14 on the one hand and the magnets 16 on the other hand allows the passage of the contracted central part of the tube 11.

The disc 8 is integral with a central casing 17, inside which is housed a worm 18, formed at the front end of the shaft 5 (or carried by the latter). The worm 18 is in engagement with a worm gear 19 (of FIG. 2) whereof the hub is mounted to rotate in bearings 20 and 21 located on the sides of the casing 17. The worm gear 19 is connected to rotate with a spindle 22, which passes through its hub and whereof the end outside the casing 17 supports a wheel 23 provided on its periphery with claws 24 separated by constant angular intervals, for example six claws 24 separated by angles of 60° (of FIGS. 3 and 4).

On its front face, the disc 8 also comprises four weft supports 25 (FIG. 2*a*) each of which is composed of an angular member 26 with edges inclined with respect to the axis 6 and of a securing lug 27 comprising an aperture 28. For each weft support 25, the front face of the disc 8 comprises a radial groove 29, at the bottom of which a series of tapped holes 30 is provided. The support 25 may thus be fixed in the desired radial position, by means of a screw 31 passing through the aperture 28 and screwed into one of the holes 30.

During operation, the shaft 5 is set in continuous rotation in the direction of arrow 32 and causes the tube 11 to rotate therewith, the free end of which describes a circular trajectory, along a slot as of the same shape provided between the periphery of the disc 8 and that of the cover 1. The weft yarn 34, unwinding from a bobbin (not shown) located on the side of the loom, reaches the device along the axis 6 and is engaged according to the arrow 35 in the inlet of the channel 10 in the shaft 5. From there it passes through the tube 11, from which it escapes by passing through the circular slot 33. Cermaic eyelets 36,37 and 38, located respectively at the entrance to the channel 10, at the bend located at the junction of the channel 10 and of the tube 11 and at the free end of this tube 11, ensure the correct guidance of the weft 34 over the previously described path.

The weft yarn 34, supplied tangentially by the last eyelet 38 in the direction of arrow 39 (of FIG. 2), winds in successive turns around the fixed drum constituted by the four weft supports 25 carried by the disc 8. By resting against the two inclined edges of the useful parts 26 of each of the supports 25, the yarn 34 forms octagonal turns, the first of which is retained by one of the claws 24 of the wheel 23.

A whole number n of turns (of FIG. 1) determined by the reduction of the worm 18 and worm gear 19, as well as by the angular spacing of the claws 24, is wound around the supports 25, until the time when the claw 24 retaining the n turns disappears below one of the inclined edges of the part 26 of the adjacent support 25. These n turns are thus released and may be drawn-off at one go in the direction of arrow 40, for the insertion of the weft yarn 34. It should be noted that at this instant, a new turn is already winding around the supports 25, while being retained by another claw 24 of the wheel 23 which arrives to take the place of that which has disappeared. The same cycle of storage and releasing the weft 34 may thus be repeated indefinitely. Each claw 24 comprises an engagement face 24' whereof the concave shape is defined in order to retain the yarn 34 without it being entrained in the descending movement of the claw 24.

In order to carry out an adjustment of the length of weft yarn 34 held in reserve in this way in the form of n turns, at the time of each cycle, the radial position of the four weft supports 25 is modified in a substantially similar manner, by using the adjustable securing means already described above (FIG. 2*a*), so that the four weft supports 25 are always located on the same circle centered on the axis 6 of the device. Another position of the four supports 25 is shown in dot dash line in FIG. 2, this position corresponding to a considerably reduced stored length of weft.

It is advisable that the wheel 23 with the claws "follow" the radial movement of the adjacent weft support 25. To this end, as shown in FIG. 2, the spindle 22 of the wheel 23 is mounted to slide inside the hub of the tangent wheel 19. At one of its ends outside the casing 17, thus hub comprises a part 41 comprising slots as well as a conical screwthread which receives a nut 42. The tightening of this nut 42 causes a connection axially and in rotation between the worm gear 19 on the one hand and the spindle 22 of the wheel 23 on the other hand.

FIGS. 5 to 7 relate to a second embodiment, whereof the parts in common with the first embodiment, designated by the same reference numerals, will not be described again.

In this second embodiment, a retaining abutment 43 is also provided, which is mounted on a support 44 in the form of an angle iron, itself fixed by a screw 45 to the periphery of the fixed cover 1.

The abutment 43, shown clearly in FIG. 7, comprises a lug 46 located in a plane parallel to the axis 6 of the device, in the vicinity of the claw wheel 23. The lug 46 is connected by an intermediate part 47 to an elongated base 48 comprising a slideway 49, for its adjustable attachment to one arm of the angle iron 44 by means of a second screw 50.

The abutment 43 intervenes by means of a lug 46 constituting its active part, at the time when the turns are supplied in the direction of arrow 40, in order to keep the new turn in position behind the claw 24 despite the influence exerted on this turn by the pulling action on the turns stored previously. In fact, the new turn is prevented from moving by its contact below the inwardly curved edge of the lug 46, preventing its movement towards the outside and consequently its escape from the claw 24. Naturally, the abutment 43 intervenes in the same way at the time of each cycle for storing and releasing the weft 34.

By virtue of the slideway 49, the position of the abutment 43 is adjustable, in a plane at right angles to the general axis 6 of the device, which makes it possible to vary the position of the lug 46 at the same time that one adjusts the position of the wheel 23 comprising claws and of the supports 25 as described above with reference to the first embodiment.

Naturally, the invention is not limited to the embodiments of this weft predelivery and measuring device for a shuttleless loom which have been described above, by way of example. On the contrary, it includes all variations based on the same principle. Thus, in particular, it is not outside the scope of the invention to modify the number and detailed shape of the claws 24 or of the weft supports 25. It should also be pointed out that in the case where the retaining abutment 43 is provided, it is possible to dispense with the support 44 in the form of an angle iron and to provide the adjustable attachment of the abutment 43 directly on the periphery of a fixed cover 1 of suitably adapted shape, or even to replace the rigid lug 46 by one or more flexible members: for example by a brush.

What is claimed is:

1. A weft predelivery and measuring device for a shuttleless loom, comprising:

a tubular member rotatable about an axis and integral with a rotary shaft which is traversed by an axial channel along which a weft yarn can pass into the tubular member;

a drum fixed with respect to said axis and defined by a plurality of radially adjustable members orbited by an end of said tubular member to allow said weft to be wound on said drum;

a worm on said shaft within said drum;

a worm gear within said drum meshing with said worm;

a second shaft connected to said worm gear and driven by the first mentioned shaft through said worm and said worm gear with a speed bearing a fixed ratio ot the speed of said first shaft determined by a transmission ratio of said worm and said worm gear;

a claw wheel on said second shaft provided with a plurality of angularly equispaced claws each having a concave face permitting retention of weft yarn until the respective claw is rotated with rotation of said claw wheel, said claw wheel being disposed relative to said radially adjustable members of said drum to enable each claw to retain successive turns of weft yarn deposited on said drum and then upon such rotation to release the turns retained by each claw and deposited on said drum all at once, said radially adjustable members being angularly equispaced adjustable weft supports, said drum further comprising a disk, and means angularly equispaced around said disk for receiving the respective weft supports and enabling the radial and concentric adjustment with respect to the axis of said first shaft, said second shaft being radially aligned with said one of said supports; and means for radially adjusting a position of said wheel with respect to said worm gear in accordance with the position of said one of said supports.

2. The device defined in claim 1 wherein each of said weft supports comprises a weft yarn receiving part having edges inclined to said axis and a securing lug for radially adjusting the position of the respective part on said disk.

3. The device defined in claim 1 wherein said second shaft is axially shiftable in said worm gear, further comprising means for locking said second shaft to said worm gear in a selected position of relative axial adjustment of said worm gear and said second shaft.

4. The device defined in claim 1, further comprising a retaining abutment adjacent said drum and said claw wheel to retain a first turn of weft yarn wound behind a following claw when an eariler claw rotates in order to release the turn previously deposited on the drum and retained by the previous claw.

5. The device defined in claim 4 wherein the retaining abutment comprises a mounting and means for adjusting the position of said mounting in a plane at a right angle to said axis of the drum.

6. The device defined in claim 5 wherein the retaining abutment comprises a rigid lug connected to a base having a slideway for adjustable attachment to a fixed cover enclosing the device.

7. The device defined in claim 6 wherein said disk and a casing enclosing said worm and said worm gear are supported by said first shaft by bearings, said cover and said disk being provided with juxtaposed permanent magnets for retaining the disk in a substantially fixed angular position, said permanent magnets being spaced apart to define a gap through which said tubular member passes.

* * * * *